US010750827B2

(12) United States Patent
Choi

(10) Patent No.: US 10,750,827 B2
(45) Date of Patent: Aug. 25, 2020

(54) CRAMPONS PROVIDED WITH SPIKES

(71) Applicant: SNOWLINE Co., Ltd., Pyeongtaesk-si, Gyeonggi-do (KR)

(72) Inventor: Jinhong Choi, Pyeongtaek-Si (KR)

(73) Assignee: SNOWLINE Co., Ltd., Pyeongtaesk-si (KR)

( * ) Notice: Subject to any disclaimer, the term of this patent is extended or adjusted under 35 U.S.C. 154(b) by 103 days.

(21) Appl. No.: 15/685,302

(22) Filed: Aug. 24, 2017

(65) Prior Publication Data

US 2018/0055149 A1 Mar. 1, 2018

Related U.S. Application Data

(60) Provisional application No. 62/380,359, filed on Aug. 26, 2016.

(51) Int. Cl.
*A43C 15/06* (2006.01)
*A43C 15/10* (2006.01)

(52) U.S. Cl.
CPC ..... *A43C 15/061* (2013.01); *A43C 15/063* (2013.01); *A43C 15/066* (2013.01); *A43C 15/068* (2013.01); *A43C 15/10* (2013.01)

(58) Field of Classification Search
CPC ... A43C 15/061; A43C 15/063; A43C 15/065; A43C 15/066; A43C 15/08; A43C 15/10
See application file for complete search history.

(56) References Cited

U.S. PATENT DOCUMENTS

| | | | | |
|---|---|---|---|---|
| 1,375,254 | A * | 4/1921 | Krizan | A43C 15/066 36/64 |
| 1,408,388 | A * | 2/1922 | Noblette | A43C 15/10 36/7.7 |
| 5,909,945 | A * | 6/1999 | Noy | A43C 15/00 152/208 |
| 7,428,788 | B2 * | 9/2008 | Choi | A43C 15/063 36/59 R |
| RE46,681 | E * | 1/2018 | Choi | |
| 2006/0156577 | A1 * | 7/2006 | Choi | A43C 15/063 36/7.6 |
| 2011/0258878 | A1 * | 10/2011 | Jones | A43C 15/063 36/62 |
| 2016/0324272 | A1 * | 11/2016 | Kim | A43C 15/061 |
| 2017/0065009 | A1 * | 3/2017 | Kim | A43C 15/06 |

* cited by examiner

*Primary Examiner* — Sharon M Prange
(74) *Attorney, Agent, or Firm* — Lucas & Mercanti, LLP

(57) ABSTRACT

Disclosed are chain-type crampons for preventing mountain-climbing boots from being slipped on a snowy road or icy road when climbing a mountain. The crampons having an elastic band and chains mounted on the band are provided with a plurality of spikes and link rings including an advanced spike on the front of the boot when so mounted, so that a brake power on the snowy road or icy road is increased and snow is not adhered to the crampons. The crampons have a restraining member at the front.

9 Claims, 11 Drawing Sheets

CRAMPONS PROVIDED WITH SPIKES

CROSS-REFERENCE TO RELATED APPLICATION

This application claims the benefit of U.S. Application Ser. No. 62/380,359 filed Aug. 26, 2016, the entire contents of which are incorporated herein by reference.

FIELD OF THE INVENTION

The present invention relates to crampons for preventing mountain-climbing boots from being slipped on a snowy road or icy road when climbing a mountain in the winter season, and more particularly, to chain-type crampons having an elastic band and chains mounted on the band which are provided with a plurality of spikes and link rings, so that a brake power on a snowy road or icy road is increased and snows are not adhered to the crampons.

BACKGROUND OF THE RELATED ART

In general, since temperatures are low, and snows and ices pile up on the ground, in the winter season, snowy roads or icy roads are formed on mountain passes. Climbers are frequently slipped on the snowy road or icy road through carelessness or beyond human control, when climbing a mountain, so that climbers are bruised or are seriously wounded, such as a fracture.

In order to prevent the emergency situations, most of the mountain-climbing boots are put on crampons. The climbers carry the crampons at ordinary times, and put the crampons on the boots in an area with snowy roads or icy roads, thereby keeping a body in safe and thus preventing the slip.

The existing crampons are generally put below a bottom surface of the boots to prevent the slip on the snowy roads or icy roads in the winter season. The crampons includes a body and a binding band, in which the body is downwardly bent to form about 4 to 6 spike edges at the bottom surface thereof, and the binding band is coupled to the body to tightly bind the body against the outsole of the boots, when the climber puts the crampons on the boots.

In order to shorten a time required to put the crampons on the boots or remove the crampons from the boots, the binding band of the crampons is provided with a fastening member having a hook and a coupling ring. For example, crampons capable of shortening the time required to put on the crampons is disclosed in Korean Utility Model Registration No. 20-0252026 entitled "Crampons", which is assigned to the same applicant and is incorporated herein by reference.

According to the crampons disclosed in the publication, an elastic band is bound around the upper portion of an outsole of mountain-climbing boots, and chains are coupled to the band as an anti-skid member. The chains are coupled to each other to partially cover the bottom surface of the boots, thereby preventing the slip of the boots due to the friction between the crampons and the snowy road or icy road.

When the climber puts the crampons on the boots, a front heel portion is firstly inserted in the widened elastic band, and the band is pulled to enable it to cover the upper portion of the outsole corresponding to a rear heel. The crampons are tightly attached to the boots due to the elastic force of the band, and the chains are disposed below the bottom surface of the boots.

The existing crampons have a discomfort drawback in that the snows are adhered to the chains when temperatures are low. Specifically, snows adhered between the chains are gradually getting bigger. Further, in case the chains disposed at the rear heel portion of the boots are applied with strong frictional force when climbing a steep slope, the band tightly covering the front heel portion of the boots is stretched, so that the wearing state of the band is deteriorated.

Also, in addition to the drawback that the snows are adhered between the chains to make the behavior discomfort, the brake power on the snowy road or icy road is remarkably decreased.

U.S. Pat. No. 7,428,788, also to the same inventor as herein, is incorporated by reference herein, and relates to a crampon having chains and spikes, but does not disclose spikes forward of the front spikes.

SUMMARY OF THE INVENTION

Accordingly, the present invention is directed to crampons for mountain-climbing boots that substantially obviates one or more problems due to limitations and disadvantages of the related art.

An object of the present invention is to provide chain-type crampons having an elastic band and chains mounted on the band which are provided with a plurality of spikes and link rings, so that a brake power on a snowy road or icy road is increased and snows are not adhered to the crampons.

To achieve the object and other advantages, according to one aspect of the present invention, there are provided chain-type crampons provided with spikes, in which an elastic band is bound around an outsole of mountain-climbing boots, and chains are coupled to the band as an anti-skid member, the crampons comprising: a front spike, a prefrontal or advanced spike forward of the front spike, a center spike, and a rear spike, respectively, disposed at a front portion, a center portion, and a rear portion of a bottom surface of the boots, engaged to the chain and coupling rings, and formed with a plurality of spike edges; lateral spikes disposed forward between the front spike and the center spike and engaged to the chain and the coupling ring; and link rings each engaged to the advanced spike, front spike, the lateral spikes, and the center spikes: a restraining member coupled to the lateral spikes tightly attached to a front heel of the boots may also be provided.

The prefrontal or advanced spike(s) can increase the stability of the boot and wearer's foot, not being pushed behind up to the end of spikes when used for going on steep slopes.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

A preferred embodiment according to the present invention will now be explained with reference to the accompanying drawings.

Figure 1:
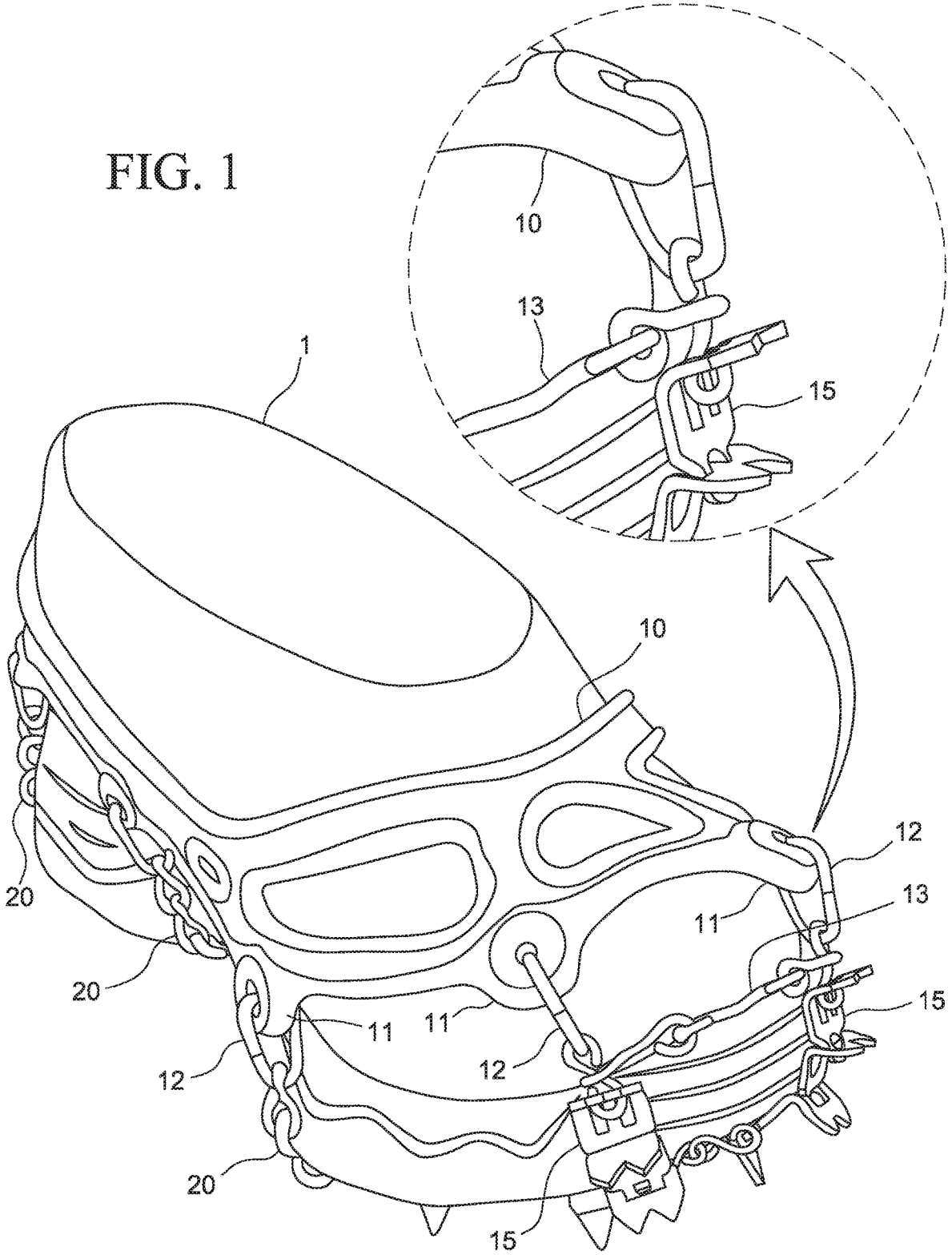
FIG. 1 is a perspective view of a first embodiment of the invention.

The chain-type crampons installed with spikes according to a first embodiment of the present invention (see FIGS. 1, 2A, 2B, 2C, 2D, 3 and 3A), in which an elastic band 10 is bound around an outsole of mountain-climbing boots 1, and chains 20 are coupled to the band 10 as an anti-skid member, is characterized by comprising: at least one prefrontal or advanced spike 15 (shown are three), a front spike 30, a center spike 50, and a rear spike 60, respectively, disposed at a prefrontal or advanced front portion, a front portion, a center portion, and a rear portion of a bottom surface of the boots 1, engaged to the chain 20 and coupling rings 21, 23, 24, and 25, and formed with a plurality of spike edges 33, 53, and 63; lateral spikes 40 disposed forward between the front spike 30 and the center spike 50 and engaged to the chain 20 and the coupling ring 22; link rings 70 and 80 each engaged to the front spike 30, the lateral spikes 40, and the center spikes 50; and a restraining member 13 coupled to the top of the advanced spikes 15 tightly attached to a front heel of the boots 1, as shown in FIG. 1.

The elastic band 10 made of rubber or synthetic material is adapted to cover the upper portion of the outsole of the boots 1, and bosses 11 protrudes from an outer edge of the band 10 at a desired interval so that fixing rings 12 are mounted to the bosses 11. The chains 20 and the coupling rings 21, 22, 23, and 24 are coupled to a plurality of fixing rings 12 spaced apart from each other at a given interval.

The coupling rings 21, 23, and 24 are coupled to the front, center, and rear spikes 30, 50, and 60 each integrally formed with bent spike edges 33, 53, and 63. The front, center, and rear spikes 30, 50, and 60 are disposed at the front, center, and rear portions on the bottom surface of the boots 1. The lateral spikes 40 are disposed at both sides between the front spike 30 and the center spike 50, and are coupled by the chain 20 and the coupling ring 22.

The advanced spikes 15, front spike 30, the center spike 50, and the rear spike 60, which are disposed at the front, center, and rear portions of the bottom surface of the boots 1, respectively, are formed with fastening holes 31 and 32; 51 and 52; 61 and 62 at both lateral ends and a center portion thereof. Also, the front spike 30, the center spike 50, and the rear spike 60 are bent at the side thereof to integrally form the spike edges 33, 53, and 63.

The lateral spikes 40 disposed at both front sides on the inner bottom surface of the boots 1 are formed with fastening holes 41 and 42 at both lateral ends and center portion, and are bent toward the bottom surface to form the spike edge 43.

The front spike 30, the center spike 50, and the rear spike 60, which are disposed at the front, center, and rear portions of the bottom surface of the boots 1, respectively, are coupled to a plurality of link rings 70 configured to freely pivot. The rear spike 60 is coupled to the center spike 50, the link ring 80, and the chain, with it being mounted to the chain 20 and the coupling ring 24.

The link ring 70 positioned at the front portion of the bottom surface of the boots 1 is bent to be pivotally inserted into is bent to be pivotally inserted into the fastening holes 32, 42, and 52 of the front spike 30, the center spike 50, and the rear spike 60. The front spike 30 and the lateral spikes 40 are coupled to the chain 20 and the band 10 via the fastening holes 31 and 41 formed at center portion and the coupling rings 21 and 22.

The rear spike 60 is disposed at the rear portion of the inner bottom surface of the boots 1, and is coupled to the center spike 50 by connecting the fastening hole 51 of the center spike 50 disposed at the center portion with the fastening hole 61 positioned at the center portion by use of the link ring 80, the chain 20, and the coupling ring 25, with the fastening hole 62 formed at both sides of the elastic ban 10 being mounted with the chain 20 and the coupling ring 24.

The chain-type crampons provided with spikes according to the first embodiment of the present invention includes the front spike 30, the lateral spikes 40, the center spike 50, and the rear spike 60, which are disposed at the front, both sides, center, and rear portions on the inner bottom surface of the boots 1 and have spike edges 33, 43, 53, and 63, respectively, thereby increasing a brake power on a snowy road or icy road.

With the chain-type crampons provided with spikes according to the first embodiment of the present invention, in order to prevent the band 10 tightly attached to the boots 1 from being stretched when the front spike 30, the lateral spikes 40, the center spike 50, and the rear spike 60 are applied with strong frictional force in climbing a steep slope, both chains 20 tightly attached to the front heel of the boots 1 are provided with the restraining member 13, so that the restraining bar 13 is restrained by the front heel portion of the boots 1 to prevent the stretching of the band 10. In this embodiment, the restraining member 13 is in the form of three links, 13A, 13B, and 13C.

Consequently, the first embodiment of the present invention includes the prefrontal or advanced spikes 15, front spikes 30, the lateral spikes 40, the center spike 50, and the rear spike 60, respectively, disposed to the prefrontal or advanced front, front, both sides, center, and rear portions on the inner bottom surface of the boots 1 which comes in contact with the snowy road or icy road, to increase the brake power and thus prevent the slip effectively. Also, the front spike 30, the lateral spikes 40, the center spike 50, and the rear spike 60 are coupled to the link rings 70 and 80 configured to be freely pivoted, thereby solving the existing problem in that the snow is adhered to the boots.

Specifically, the advanced spike 15, front spike 30, the lateral spikes 40, the center spike 50, and the rear spike 60, respectively, disposed to the advanced front, front, both sides, center, and rear portions on the inner bottom surface of the boots 1 are coupled to each other by use of the link rings 70 and 80 made of an iron wire to solve the problem in that the snow is adhered to the boots, breaking from the chain structure of the existing crampons.

According to the present invention, the advanced spike 15, front spike 30, the lateral spikes 40, the center spike 50, and the rear spike 60, respectively, having a plurality of spike edges 33, 43, 53, and 63, are provided to the existing crampons, thereby effectively preventing the slip of the boots 1 on the snowy road or icy road.

The restraining member 13 keeps the fixing rings 12 tightly attached to the front heel of the boots 1. Hence, in case the front spike 30, the lateral spikes 40, the center spike 50, and the rear spike 60 are applied with the strong frictional force in climbing a steep slope, the restraining member 13 is caught by the front heel portion of the boots 1, thereby preventing the band 10 from being stretched and thus maintaining the normal wearing state.

With the above description, the chain-type crampons of the first embodiment of the present invention having the elastic band and the chains mounted on the band are provided with a plurality of spikes and link rings, so that the brake power on the snowy road or icy road is increased, and the snow is not adhered to the crampons. In particular, the restraining member is installed to the front portion of the boots, thereby increasing the binding force of the crampons.

Figures 2A, 2B:
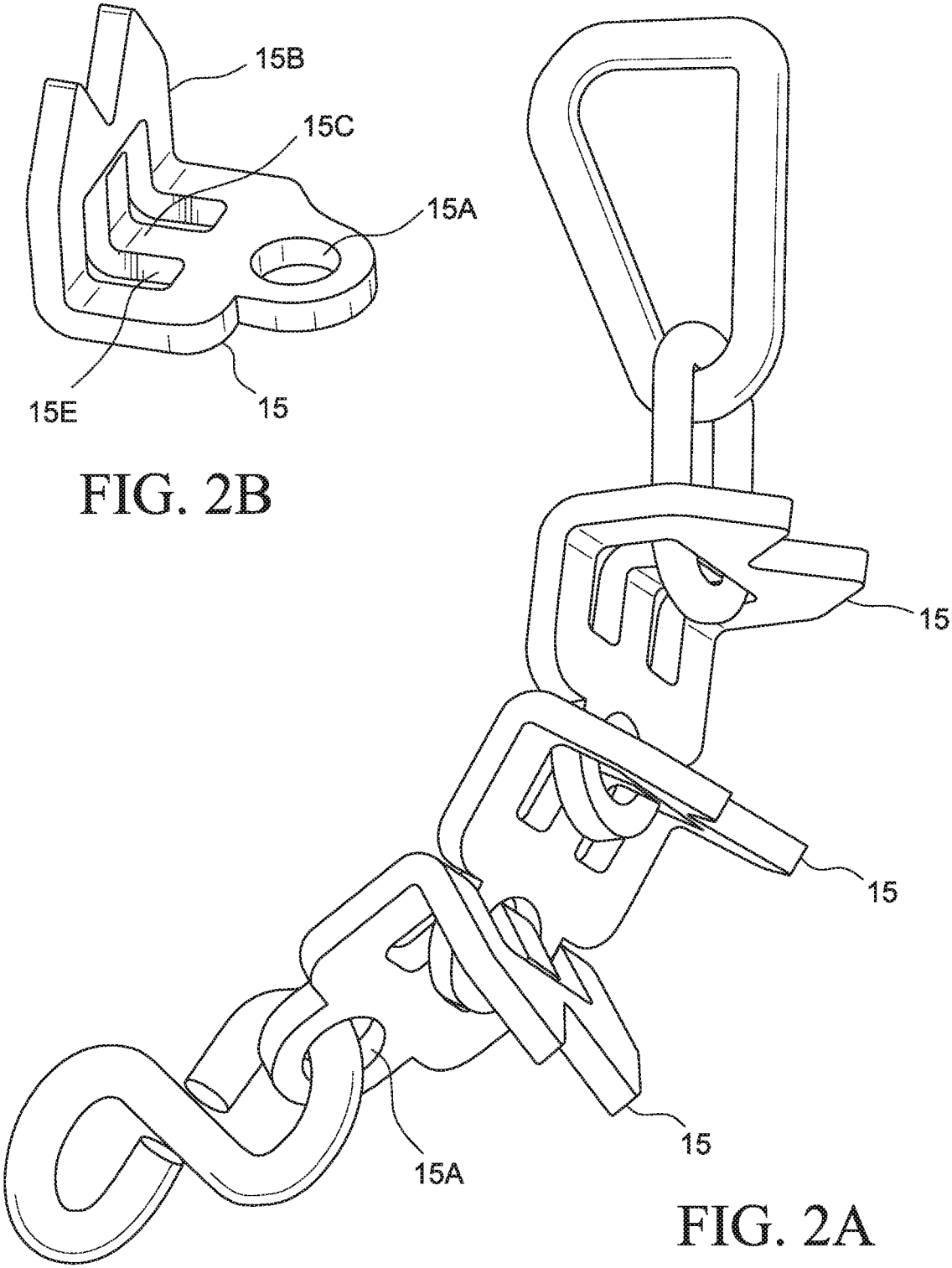
FIG. 2A is a perspective view of the prefrontal or advanced front spike portion of the first embodiment.
FIG. 2B is a perspective view of a spike piece of the prefrontal or advanced front spike portion of the first embodiment.

As shown in FIGS. 2A and 2B three advanced spikes 15 are provided on each of the front right and front left of the boot. Each advanced spike 15 is in the shape of an L, with a hole 15A in one leg of the L and a spike tip 15B, and an inner connecting member 15C in the other leg of the L identified by a cut-out portion 15E and gap 15F. The three spikes can be connected serially together by inserting the tip 15 of one inner connecting member 15C into the hole 15A of another advanced spike and then bending the inner connecting member 15C at its base to close the gap, thereby preventing the advanced spikes from separating.

Figure 4:
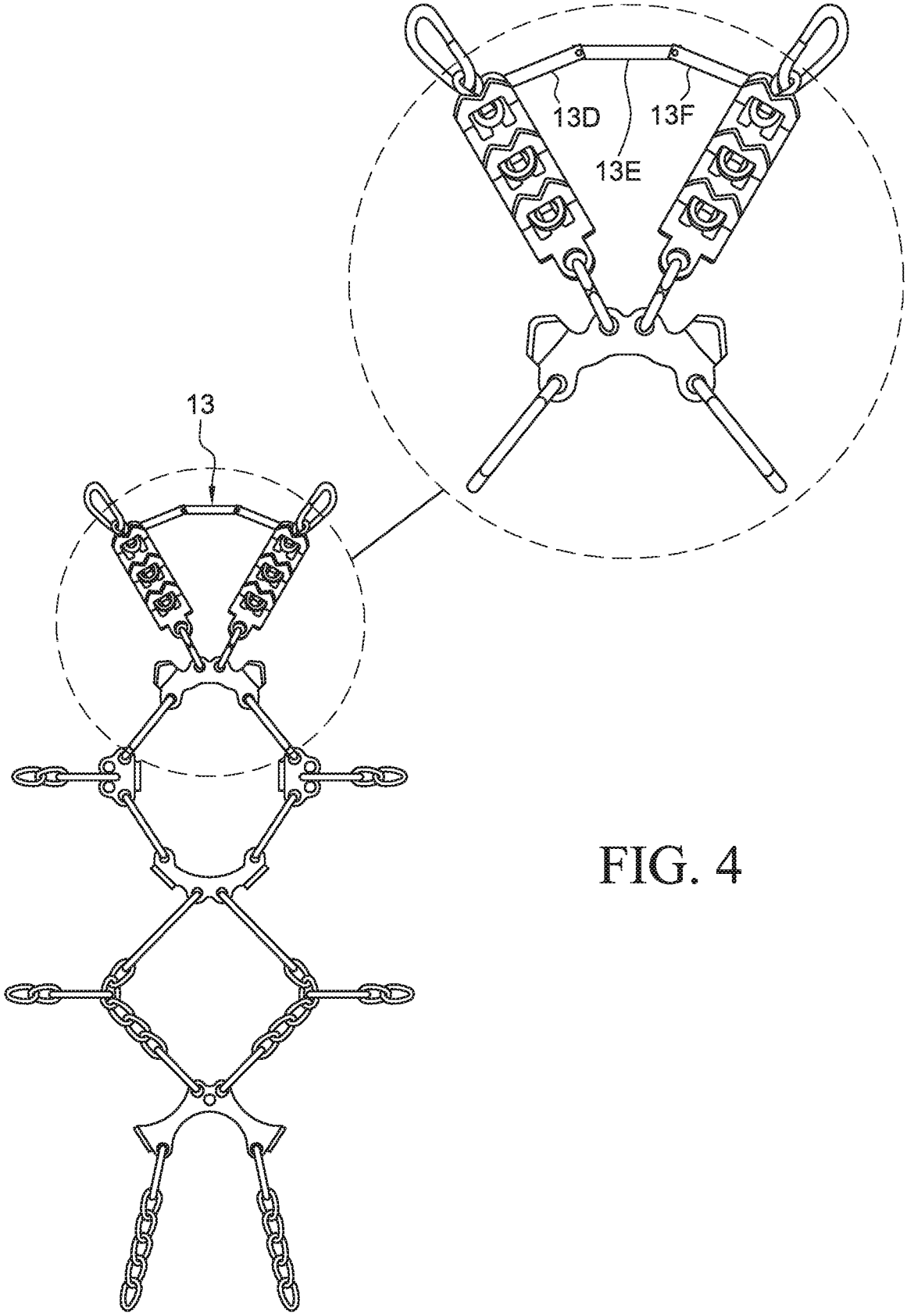
FIG. 4 is a plan view of a second embodiment of the invention with a variant restraining member different from that of the first embodiment.
Figure 4A:
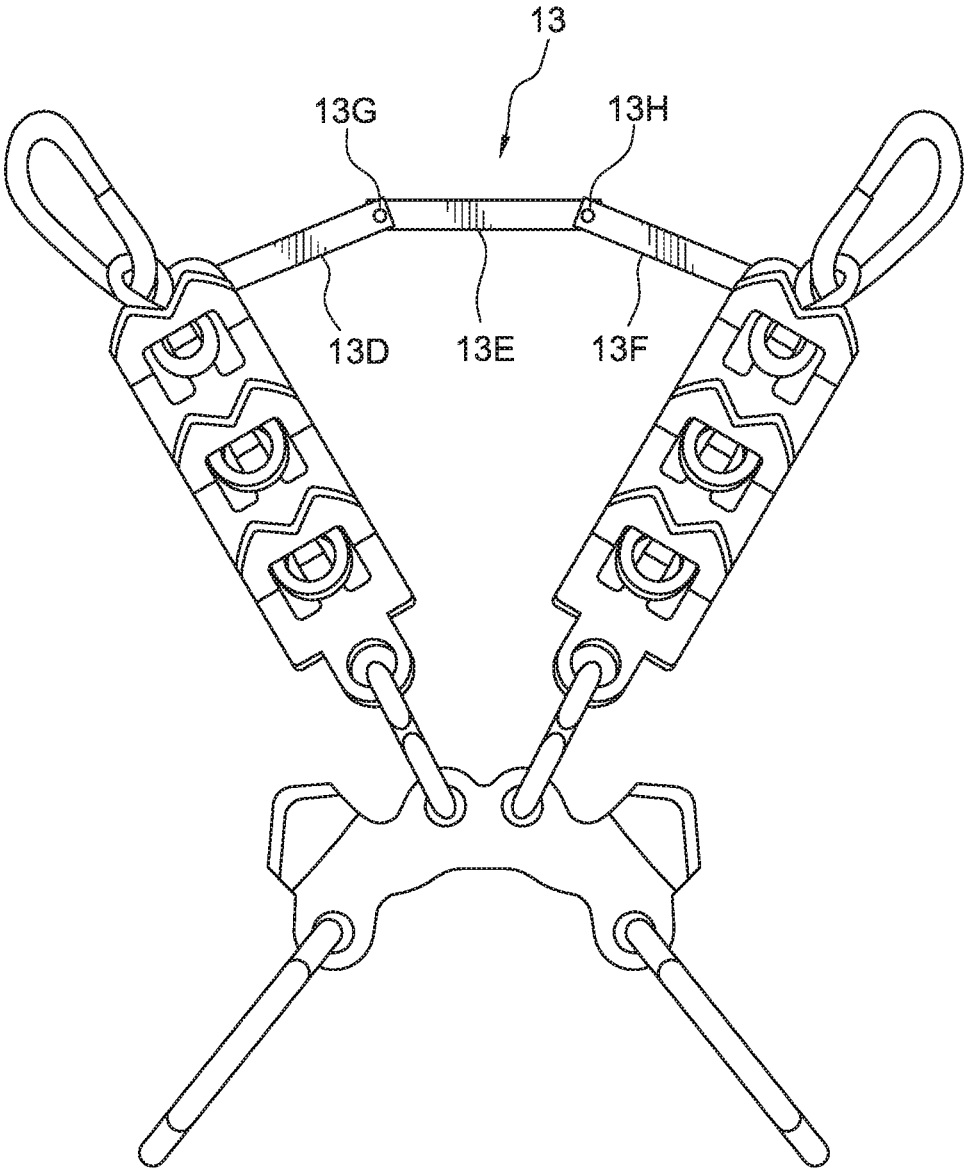
FIG. 4A is a plan view of the front portion of the second embodiment.

FIGS. 4 and 4A show a second embodiment similar to the first embodiment, except that restraining member 13 is in the form of three bars 13D, 13E, and 13F which are pinned to each other at their respective ends, permitting relative hinged movement about pin axes 13G and 13H.

Figure 5:
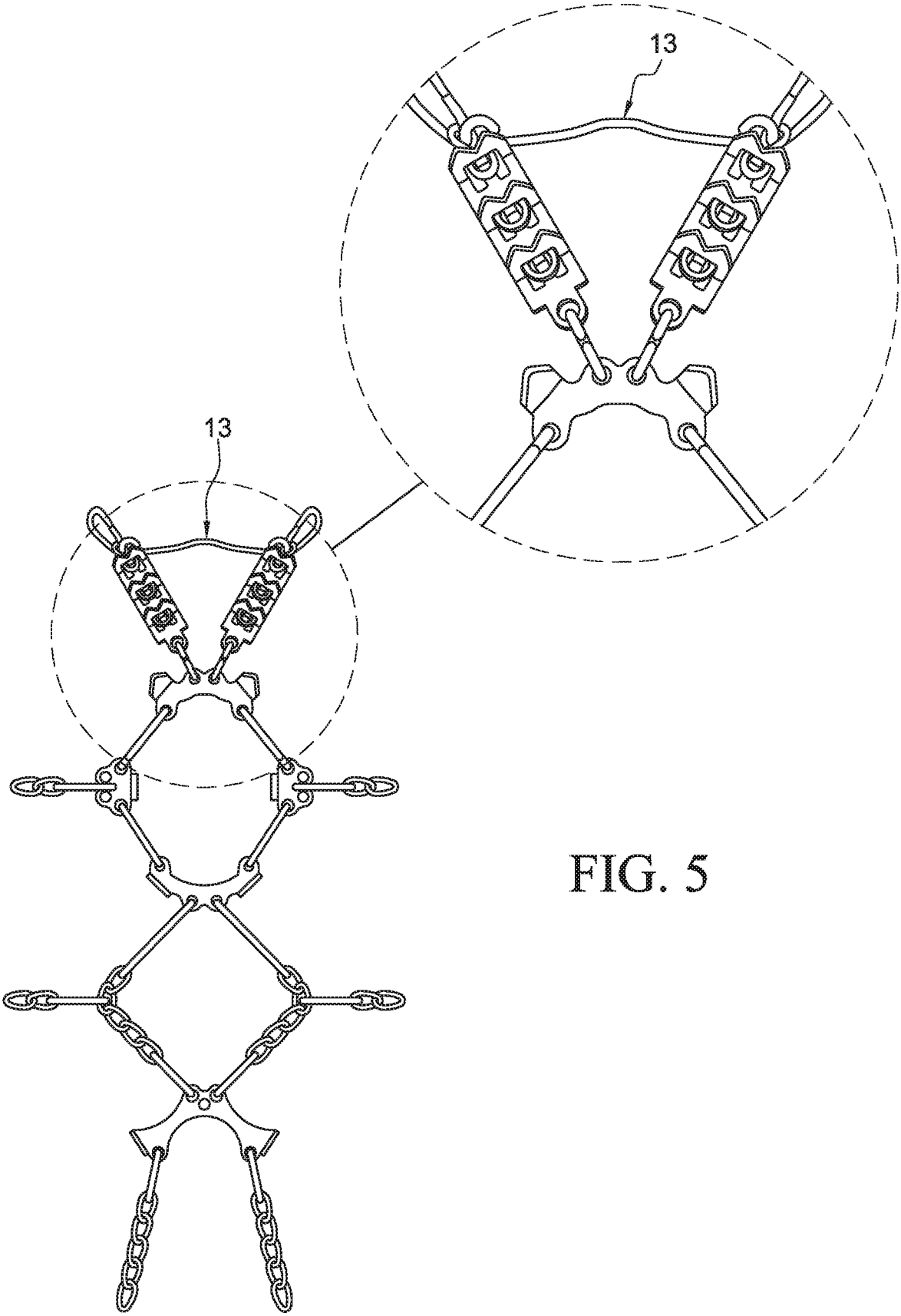
FIG. 5 is plan view of a third embodiment of the invention with another variant restraining member different from that of the first and second embodiments.
Figure 5A:
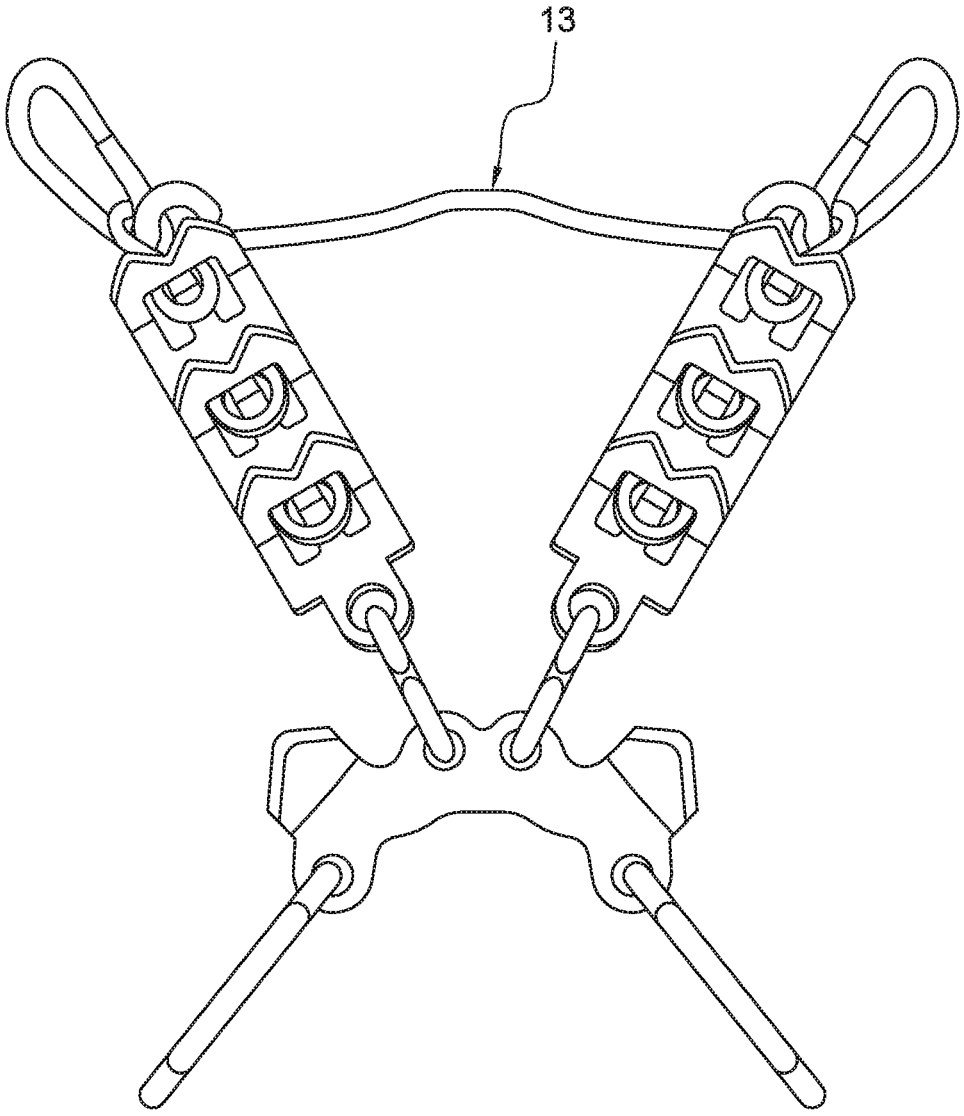
FIG. 5A is plan view of the front portion of the third embodiment.

FIGS. 5 and 5A show a third embodiment of the invention similar to the first and second embodiments, except that the restraining member 13 is in the form of a single link.

Figure 6:
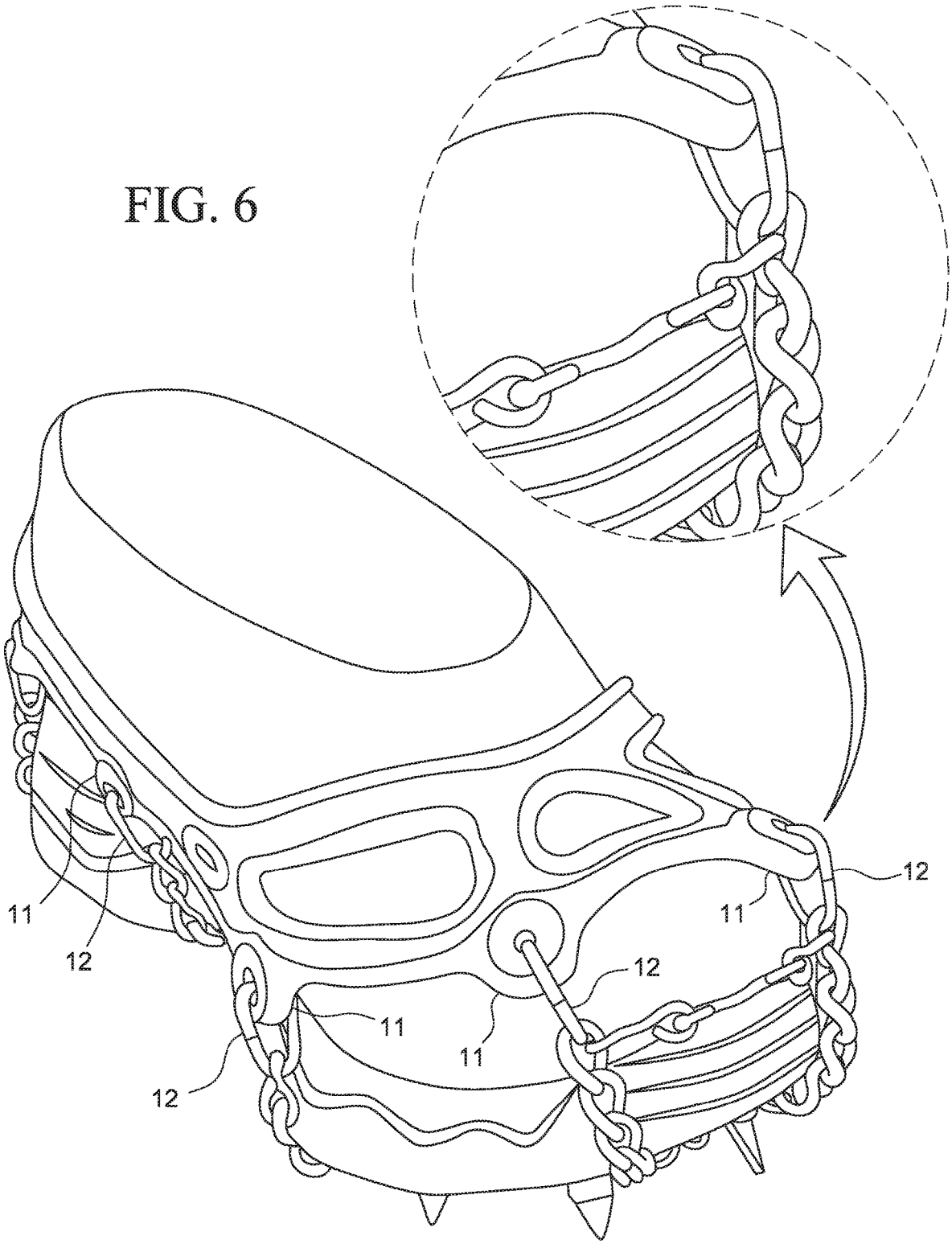
FIG. 6 is a perspective view of a fourth embodiment of the invention.

FIG. 6 shows a fourth embodiment of the invention, similar to the first embodiment of FIGS. 1, 2A, 2B, 2C, 2D, 3 and 3A, with the same restraining member 13, except that this embodiment does not have advanced spikes 15 at the front of the boot 1.

Figure 2C:
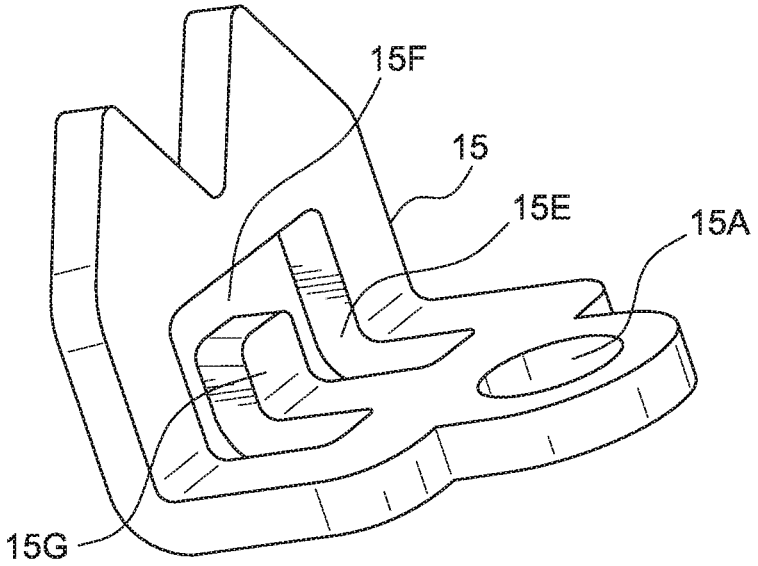
FIGS. 2C and 2D are perspective views of spike pieces of the prefrontal or advanced front spike portion of the first embodiment.
Figure 2D:
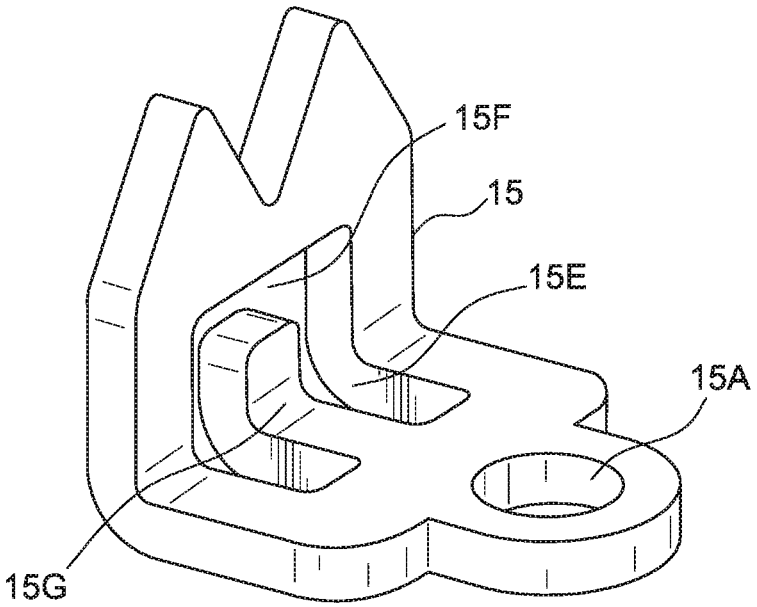
Figure 3:
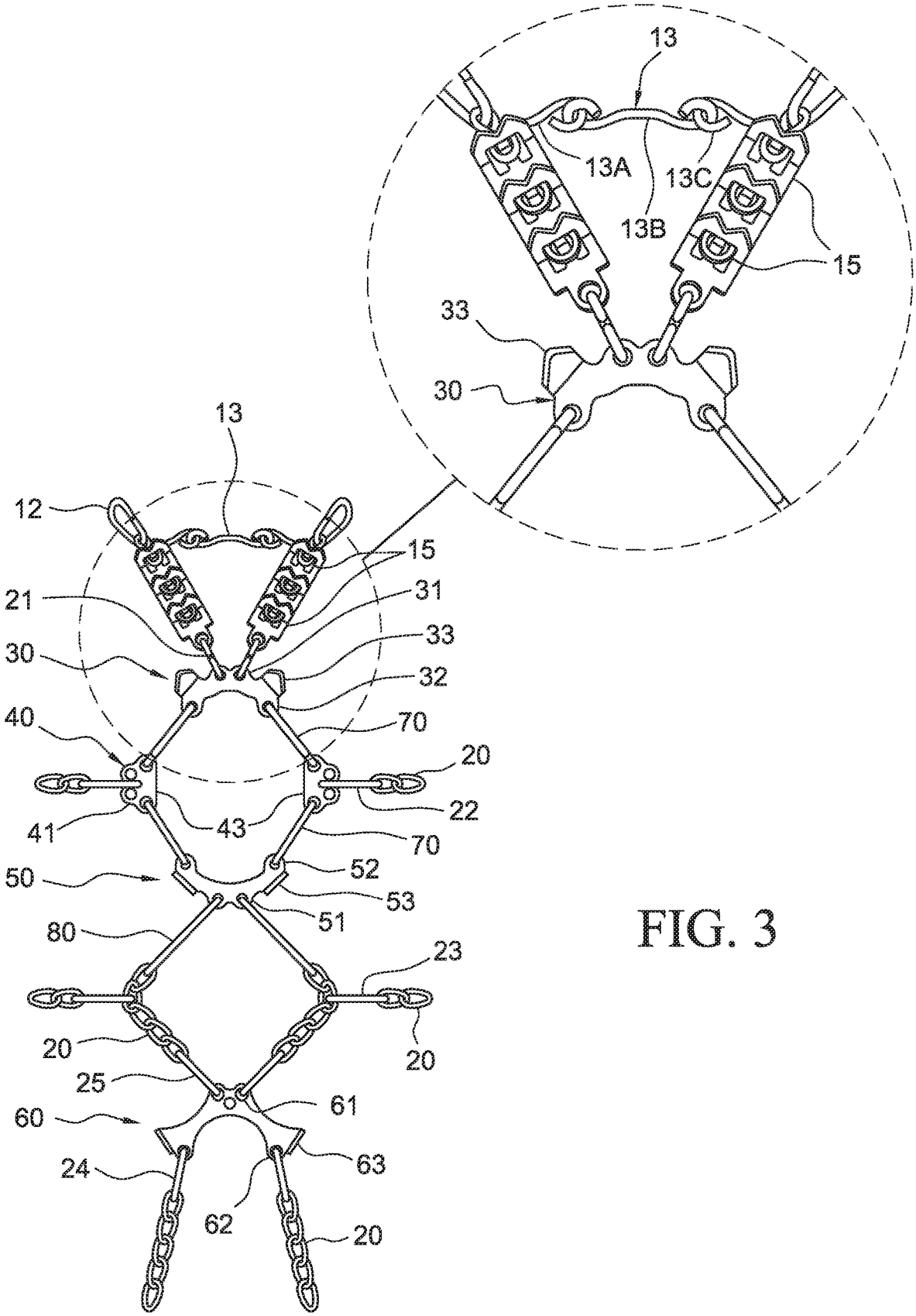
FIG. 3 is a plan view of the first embodiment.
Figure 3A:
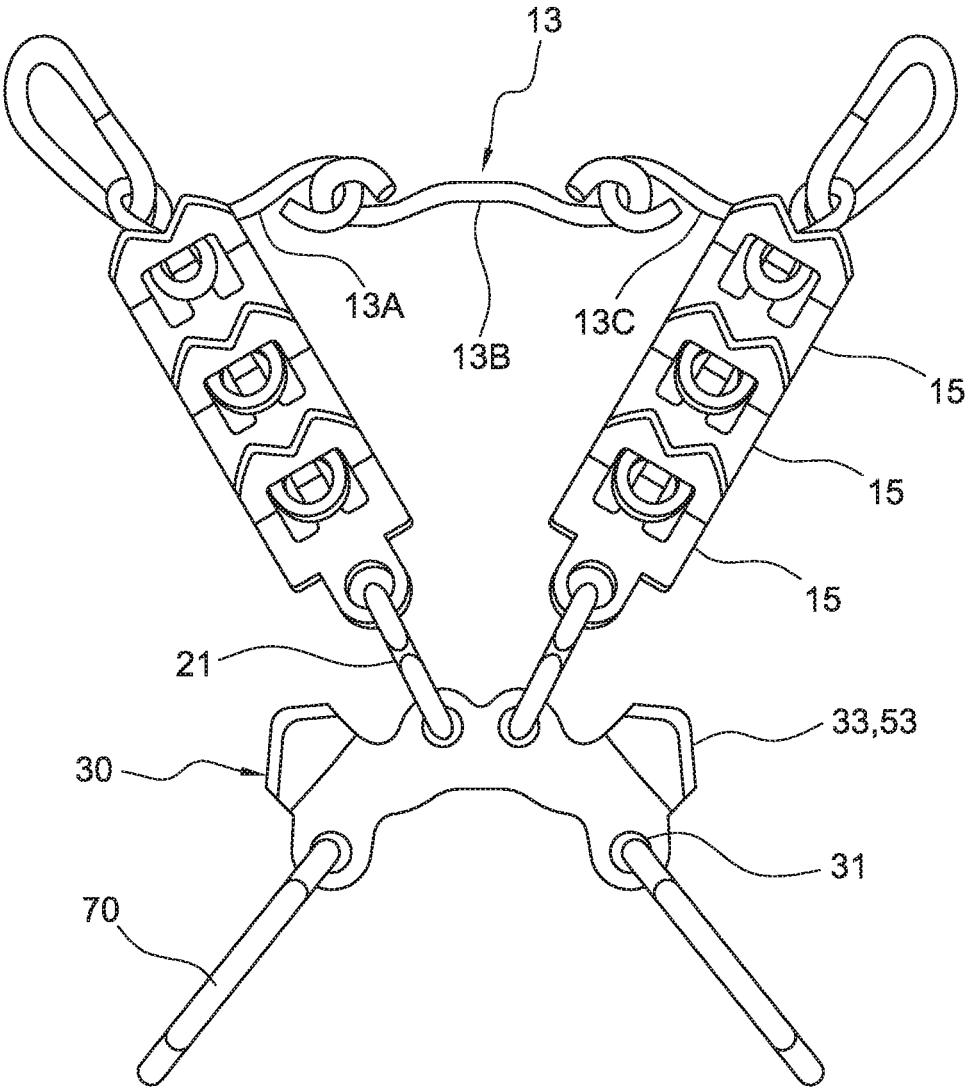
FIG. 3A is a plan view of the front portion of the first embodiment.
Figure 7:
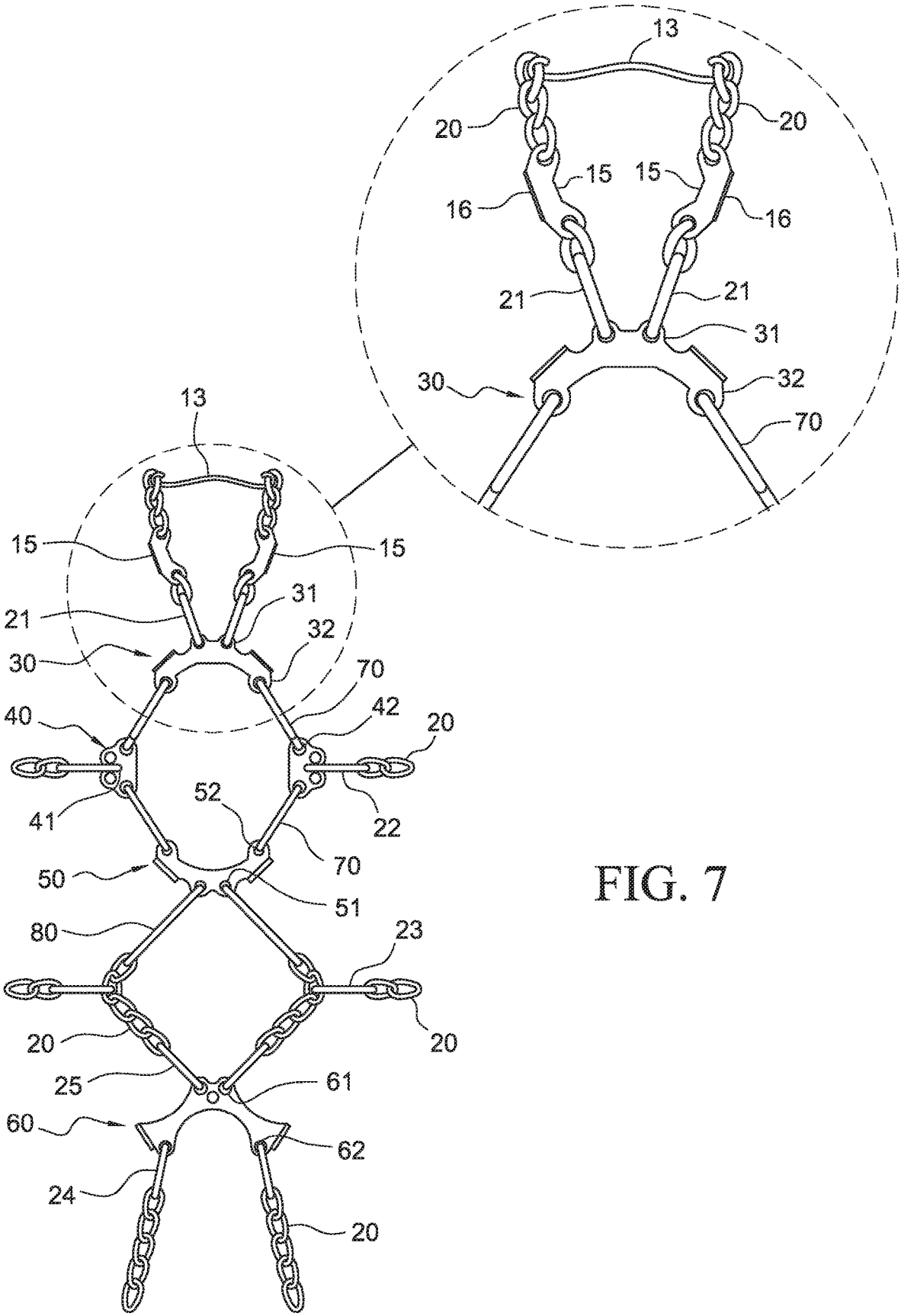
FIG. 7 is plan view of a fifth embodiment of the invention.

FIG. 7 shows a fifth embodiment of the invention, similar to the embodiment of FIGS. 5 and 5A, except that the advanced spikes 15 are in the form of a single plate instead of three connecting links of FIGS. 2C and 2D.

The forgoing embodiments are merely exemplary and are not to be construed as limiting the present invention. The present teachings can be readily applied to other types of apparatus. The description of the present invention is intended to be illustrative, and not to limit the scope of the claims. Many alternatives, modifications, and variations will be apparent to those skilled in the art.

What is claimed is:

1. A crampon system comprising:

an elastic band adapted to be bound around an outsole of a boot, and a crampon comprising:

a front spike having a plurality of first spike edges, the front spike adapted to be positioned at a front portion of a bottom surface of the boot when the elastic band is bound around the outsole of the boot;

a center spike having a plurality of second spike edges, the center spike being coupled to the elastic band via a first chain, the center spike adapted to be positioned at a center portion of the bottom surface of the boot when the elastic band is bound around the outsole of the boot; and a rear spike having a plurality of third spike edges, the rear spike being coupled to the elastic band via a second chain, the rear spike adapted to be positioned at a rear portion of the bottom surface of the boot when the elastic band is bound around the outsole of the boot;

a plurality of lateral spikes disposed between the front spike and the center spike, each lateral spike coupled to the elastic band via a respective third chain;

first and second front chains disposed between the front spike and the band, each of the first and second front chains comprising a plurality of advanced front spikes connected together in a series, each advanced front spike having an L-shape comprising a first leg and a second leg, wherein:

the first leg comprises a first surface associated with a first plane, and a hole in the first surface;

the second leg comprises a second surface associated with a second plane different from the first plane;

the first surface and the second surface intersect to form a corner;

a gap is defined in the first surface of the first leg, in the second surface of the second leg, and in the corner, the gap defining a projecting element, the projecting element having a first portion in the first leg, a second portion in the second leg, and a bend in the corner, the gap being present on two sides of the first portion of the projecting element in the first leg and on three sides of the second portion of the projecting element in the second leg;

the gap is adapted to receive an adjacent first leg of an adjacent advanced front spike; and the projecting element is adapted to connect to an adjacent hole of the adjacent first leg of the adjacent advanced front spike; and a restraining member operatively coupled to the first and second front chains, the restraining member adapted to be engaged with a front of the boot when the elastic band is bound around the outsole of the boot.

2. The crampon system of claim 1, wherein each of the front spike, the center spike, and the rear spike comprises a respective first lateral end having a respective first fastening hole, a respective second lateral end having a respective second fastening hole, and a respective center portion, and each of the front spike, the center spike, and the rear spike comprises a respective bent side that forms the respective spike edges.

3. The crampon system of claim 1, wherein the restraining member comprises first and second links, the first link being different from and connected to the second link, the first link being different from and connected to the first front chain, the second link being different from and connected to the second front chain.

4. The crampon system of claim 1, wherein the restraining member comprises first, second, and third bars, the first bar being different from and connected to the second bar, the first bar being different from and connected to the first front chain, the third bar being different from and connected to the second bar, the third bar being different from and connected to the second front chain.

5. The crampon system of claim 4, wherein the second bar is connected to the first bar by a first pin and the third bar is connected to the second bar by a second pin, wherein the first and second pins allow hinged movement of the first, second, and third bars.

6. The crampon system of claim 1, wherein the restraining member comprises a single link.

7. The crampon system of claim 1, wherein the elastic band comprises fixing portions of a circular ring shape for coupling the chains.

8. The crampon system of claim 7, wherein each of the first, second, and third chains includes a fixing ring.

9. A spike member in crampons adapted to be mounted to a boot, the spike member comprising an L-shape having a first leg and a second leg, wherein:

the first leg comprises a first surface associated with a first plane, and a hole in the first surface;

the second leg comprises a second surface associated with a second plane different from the first plane;

the first surface and the second surface intersect to form a corner;

a gap is defined in the first surface of the first leg, in the second surface of the second leg, and in the corner, the gap defining a projecting element, the projecting element having a first portion in the first leg, a second portion in the second leg, and a bend in the corner, the projecting element projecting from a center of the gap such that the gap is present on two sides of the first portion of the projecting element in the first leg and on three sides of the second portion of the projecting element in the second leg;

the gap defining the projecting element is adapted to connect to an adjacent hole of an adjacent first leg of an adjacent advanced front spike by inserting the projecting element into the adjacent hole of the adjacent first leg of the adjacent advanced front spike.

* * * * *